US005611588A

United States Patent [19]

Mencel

[11] Patent Number: 5,611,588

[45] Date of Patent: Mar. 18, 1997

[54] PADDED SKI CARRIER

[75] Inventor: Kenneth G. Mencel, Bridgeport, Conn.

[73] Assignee: Ski-Eze Products International, Inc., Bridgeport, Conn.

[21] Appl. No.: 491,093

[22] Filed: Jun. 16, 1995

[51] Int. Cl.[6] ..... A63C 11/02

[52] U.S. Cl. ..... 294/149; 294/147; 280/814

[58] Field of Search ..... 294/137, 138, 294/147–157, 165, 171; 224/250, 917; 280/814, 815

[56] References Cited

U.S. PATENT DOCUMENTS

| | | | |
|---|---|---|---|
| 784,972 | 3/1905 | Barton | 294/138 |
| 3,731,348 | 5/1973 | Luehne | 280/814 |
| 3,942,636 | 3/1976 | Matsuyama et al. | 294/156 X |
| 4,377,306 | 3/1983 | Abatecola | 294/147 |
| 4,470,528 | 9/1984 | Dyess | 294/147 X |
| 4,553,779 | 11/1985 | Shortridge | 294/147 |
| 4,673,118 | 6/1987 | Kronz | 294/147 X |
| 5,056,820 | 10/1991 | Des Prez | 294/147 X |
| 5,487,582 | 1/1996 | Bourgeois et al. | 294/171 X |

*Primary Examiner*—Johnny D. Cherry
*Attorney, Agent, or Firm*—Fattibene and Fattibene; Arthur T. Fattibene; Paul A. Fattibene

[57] ABSTRACT

A padded ski carrying device consisting of a rectangular body composed of a flexible and pliable material into which is sewn a foam rubber or synthetic material pad. The body of the invention is flat, with two hook strips of a hook and pile fastener sewn along the edge and perpendicular to one short end of the rectangular body, and parallel to the longitudinal edges of the rectangular body of the device. The body consists of two sides: a bottom (interior) side and a top (exterior) side. The two hook strips face in the same direction as the bottom (interior) side of the device when the device is open (not wrapped around and securing a pair of skis) and lying flat. Sewn onto the top (exterior) of the device, at the short end of the rectangular body of the device, opposite the end onto which are sewn the two hook strips, are two pile strips of a hook and pile fastener, sewn facing outward from the top (exterior) of the device and parallel to the longitudinal edges of the device. The body of the device, when wrapped around a pair of skis, with the bottom (interior) of the device facing and in direct contact with the top surfaces of the skis (the bottom surfaces of such skis facing each other, top surfaces of the skis facing outward) secures together the pair of skis by tightening together and adhering the hook and pile fasteners to each other.

3 Claims, 3 Drawing Sheets

PADDED SKI CARRIER

INTRODUCTION

This application concerns a padded device for securing together and carrying one pair of Nordic or Alpine style snow skis, either by means of (1) an attached handle or (2) resting over one's shoulder. This device is intended for use in manually transporting skis to and from the ski lodges and ski lifts when the skis are not secured by their bindings to a skier's ski boots, particularly when the carrying distance may be lengthy. The invention allows for both a comfortable and convenient means of carrying skis through its attached handle and padded wrapping. Although there are various other inventions which have been patented which are intended for carrying ski equipment, e.g. those devices which are the subject of U.S. Pat. Nos. 3,877,623, 4,377,306, 4,786,097, 4,494,787, 4,531,661, and 5,094,479, none of those inventions combine (a) the convenience of one device, (b) the compactness of size to fit into one's pocket or inside of one's ski bib or ski clothing, and (c) the comfort and protection of a padded wrapping which serves the multiple purposes of (i) providing padded comfort when resting over one's shoulder, (ii) tightly securing the skis together and (iii) protection from ripping or damaging the material of one's ski clothing while carrying the skis over one's shoulder.

BRIEF SUMMARY OF THE INVENTION

This invention consists of a foldable and pliable ski carrier, manufactured with either a synthetic or natural fiber cloth material into which is sewn a foam rubber or synthetic rubber pad to provide comfort and protection. The material is coated with a water resisting chemical to make the material water resistant. The device, when opened, is rectangular in shape and flat. Two straps consisting of two hook strips of a hook and pile fastener are attached at the corners of one short end of the rectangular portion of the device which, when wrapped around a pair of skis, are fastened to two pile strips of a hook and pile fastener sewn into the opposite short end of the rectangular portion of the device. These two straps, and the padded rectangular portion of the device, when wrapped around the pair of skis, tightly secure the pair of skis together.

A synthetic or natural fiber cloth material handle sewn to the material of the padded rectangular portion of the device, sewn across the width and at the center of the padded rectangular portion of the device, serves as a carrying handle into which one's hand is placed when lifting and carrying the skis after wrapping the padded rectangular portion of the device around the skis and securing the skis together with the hook and pile strip fasteners.

When not being carried by the aforesaid cloth handle, the device while wrapped around and securing together the skis can be placed over and positioned on one's shoulder to provide padded comfort and prevent the ripping or damage of the material of one's ski clothing while carrying the pair of skis on one's shoulder.

The padded ski carrying device therefore provides its user with the option of carrying a pair of skis by means of its handle or, alternatively, over one's shoulder.

When not in use for the purposes of securing together and carrying of one's skis, the device can be folded together and secured by means of the hook and pile strap fasteners and can be conveniently stored and carried in one's pocket or tucked into a skier's ski bib, pants, or clothing.

The primary object of this invention is to provide a padded ski carrier which provides a comfortable means of carrying one's skis when carried over and resting upon one's shoulder, which at the same time protects one's ski clothing from ripping, damage or soiling by the skis being carried. Another object is to provide an alternative means of securing together and carrying a pair of skis by means of an attached handle. The device is designed in such a manner as to easily allow for one to switch the means of carrying the pair of skis from hand to shoulder and back as one may desire.

DETAILED DESCRIPTION

Figure 1:
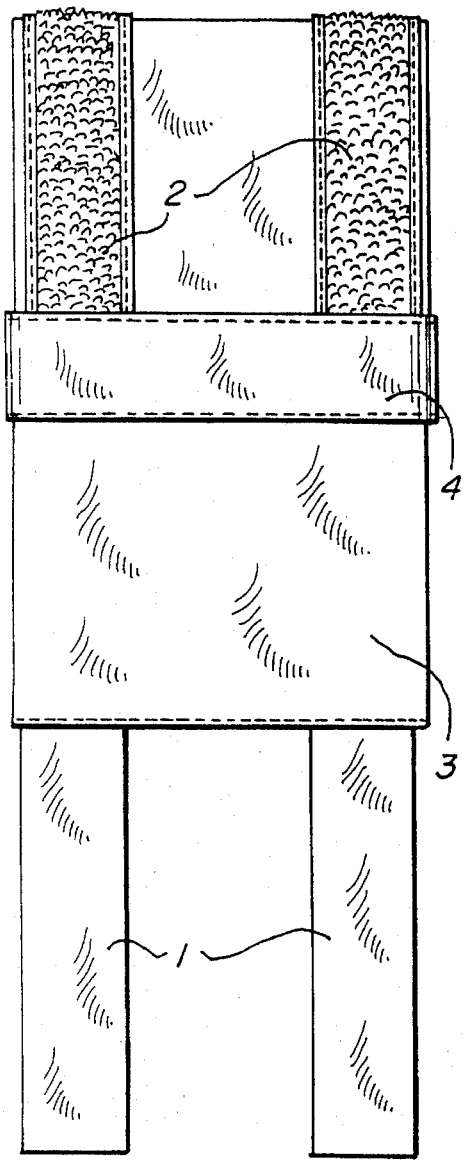
FIG. 1 is a view of the invention when opened and lying flat, as viewed from the top (exterior) side.
Figure 2:
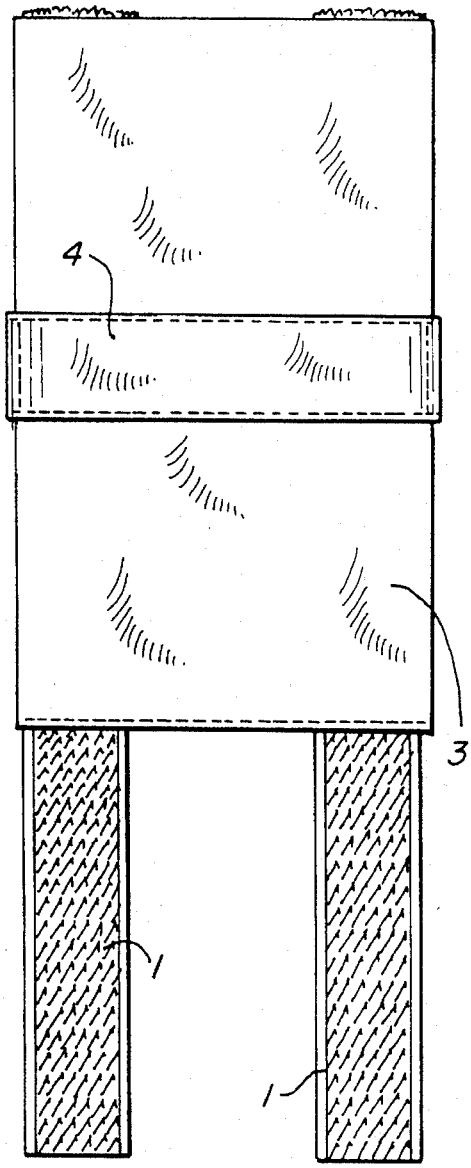
FIG. 2 is a view of the invention when opened and lying flat, as viewed from the bottom (interior) side.
Figure 3:
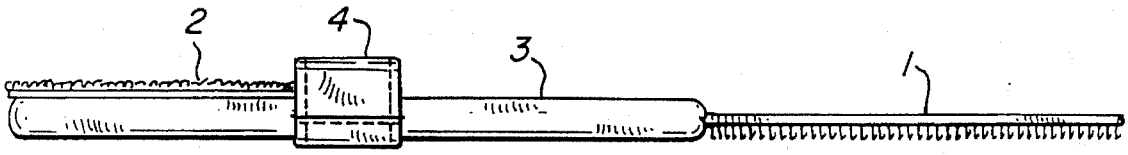
FIG. 3 is a side view of the invention when opened.

A detailed description of the device, as shown on the drawings, indicates a rectangular and foldable body 3, which, when open and not secured to a pair of skis, is flat (FIGS. 1 and 2). The device has two sides: a bottom (interior) side (FIG. 2), and a top (exterior) side (FIG. 1). The body 3 is comprised of a durable and flexible synthetic and/or natural fiber material, sewn in the form of a rectangular pocket, into which is sewn a rectangular foam rubber or synthetic rubber pad 6 to provide cushioning and padding, which foam rubber or synthetic rubber pad 6 or cushion coincides in size and shape with the body 3 of the device. The surface of the rectangular body 3 of the device, therefore, consists entirely on all sides and edges, of the material, which is sewn on all sides, and into which the foam rubber or synthetic pad 6 is contained. The material is treated with a water resistant chemical to make the device water resistant.

Figure 5:
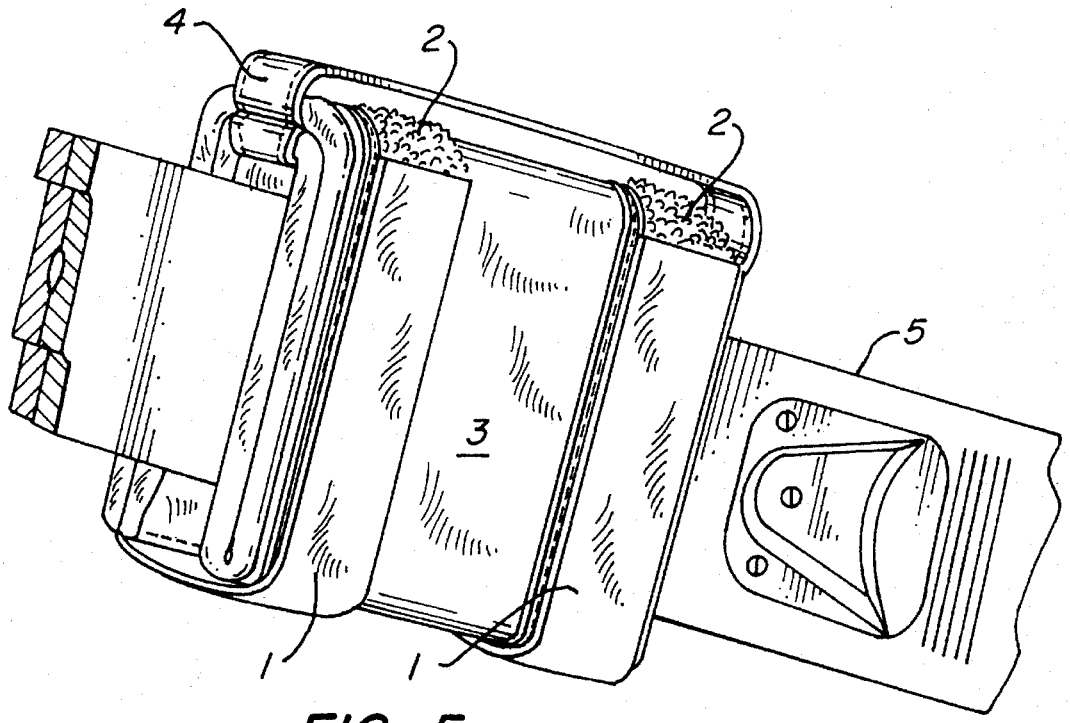
FIG. 5 is a view of the invention illustrating the fully closed device when wrapped around a typical pair of skis.
Figure 6:
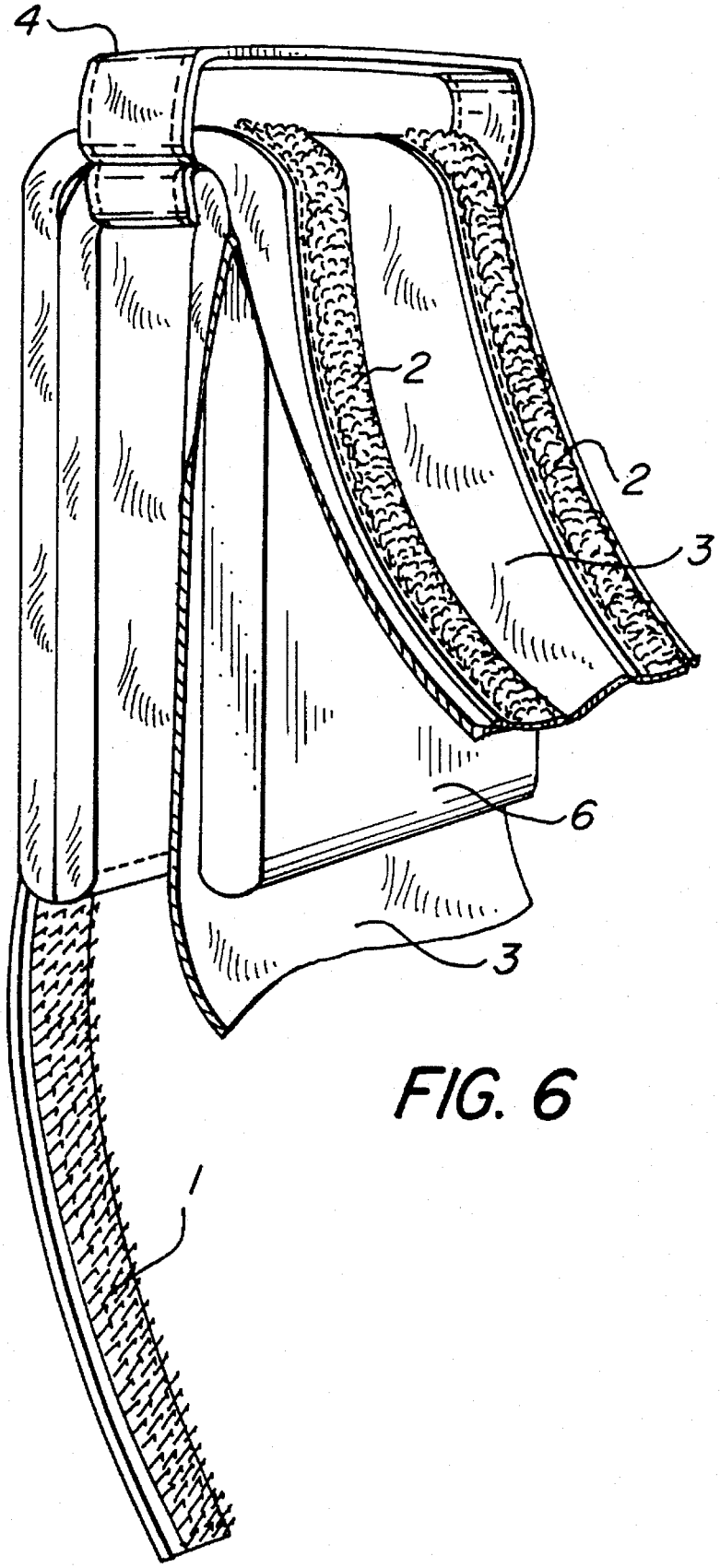
FIG. 6 is a side view of the invention showing the stitched seam opened to reveal the pad sewn into the interior of the device.

Attached as appendages to one short end of the rectangular body 3 of the device are two straps 1, which are rectangular hook strips 1 of a hook and pile fastener 1, which are secured to the body 3 by water resistant thread. FIG. 2 illustrates that said two hook strips 1 face in the same direction on the bottom (interior) side of the device when the device is open (not wrapped around and securing a pair of skis) and lying flat. The said two hook strips 1 are sewn to one short end of the rectangular body 3, in a direction parallel to the longitudinal edges of the rectangular body of the device. At the opposite short end of the rectangular body 3 of the device are sewn two pile strips 2, to which the hook strips 1 are adhered when the body 3 is folded and wrapped around a pair of skis 5 (FIG. 5 shows the device folded and wrapped around and securing together a pair of skis 5). The two pile strips 2 face outwards from the top (exterior) side of the device, and are sewn along the longitudinal edges of the device, parallel to each other and to the longitudinal edges of the device (as illustrated in FIG. 1).

Figure 4:
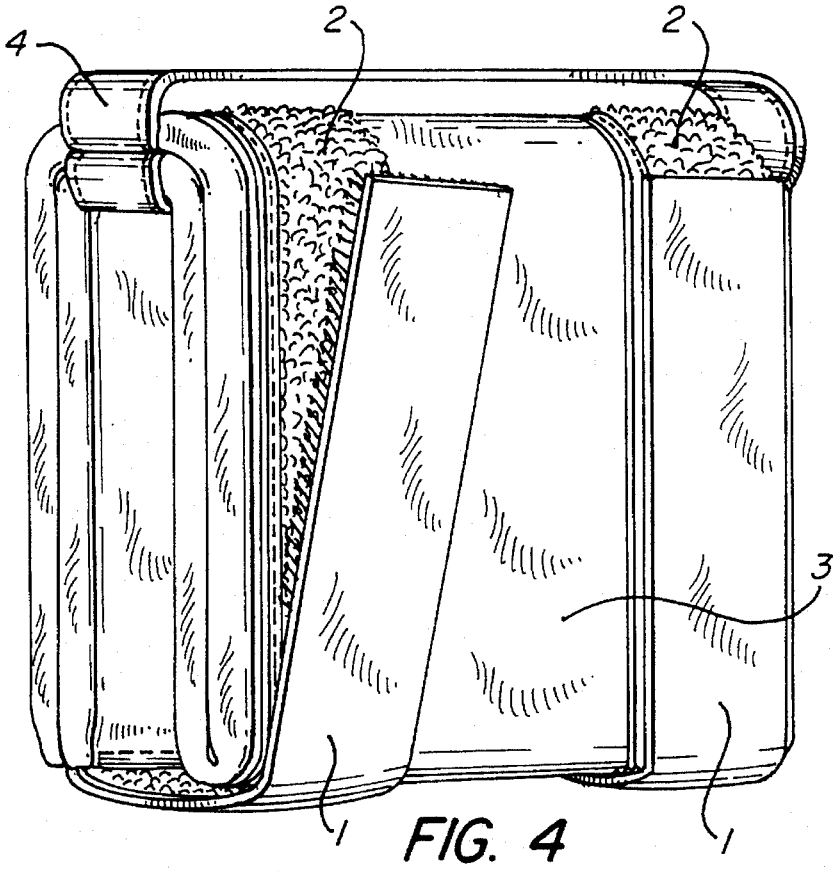
FIG. 4 is a view of the invention when closed showing one hook and pile fastener strap in the secured position (on the right end of the device as viewed) and showing the second hook and pile fastener strap in a partially secured position (on the left end of the device as viewed).

A handle 4, generally rectangular in shape, made of the same water-resistant material as the body 3 of the device is sewn transversely around the body 3 of the device, and is located at the midpoint of the body 3 of the invention. The material of the handle 4 is doubled over and sewn together along the longitudinal edges of the material comprising the handle 4 with thread stitched to provide lateral strength as well as decorative stitching. The longitudinal edges of the portion of the handle 4 in contact with the bottom (interior) side of the body 3 of the device are sewn directly onto the material constituting the bottom of the device 3 only (FIG. 2), with the material comprising the remaining portion of the handle 4 forming a loop over and around the top (exterior) of the body 3 of the device (FIGS. 1, 4 and 5). The loop thus formed is sufficiently large to permit one's hand to grasp the material of the handle 4 to permit the carrying of a pair of skis 5 when the body 3 of the device is folded and wrapped around a pair of skis 5 and is secured in place by the hook strips 1 adhered to the pile strips 2.

In wrapping the body 3 of the device around a pair of skis 5, the bottom side of the body 3 (FIG. 2) is placed in contact with the top (exterior) sides of the pair of skis 5, encircling the pair of skis 5 placed together parallel to each other, the bottom sides of each ski facing, with the top side of the body 3 (FIG. 1) facing outward, bringing the hook strips 1, located at one end of the device, over and around the pair of skis 5 in contact with the bottom of the device and over the opposite short end of the top side of the body 3 of the device, overlapping and adhering to the pile strips 2 sewn onto the top side of the opposite short end of the device, thereby tightening together and securing the body 3 of the device securely around the pair of skis.

Once the body 3 of the device has been wrapped around the paid of skis 5, and has been secured and tightened together by the hook strips 1 and pile strips 2 as aforesaid, the pair of skis 5 can be manually carried either by means of the handle 4 or by placing the pair of skis 5 held together by the padded ski carrying device over one's shoulder. When the skis are carried over one's shoulder, the present invention is situated where the skis meet the shoulder, the padded body 3 of the device resting on the shoulder and providing (a) a cushion for comfort and (b) protection from ripping and soiling of one's ski clothing from the sharp edges and often wet and dirty skis.

To the extent that modifications may be made in implementing the present invention, and to the extent that such re within the scope of the claims set forth herein, such modifications are deemed as included with this specification.

I hereby claim:

1. A padded ski carrier facilitating the portage of skis in either of two positions in a comfortable and effortless manner comprising:

a rectangularly shaped carrier body, said body including an elongated rectangularly shaped fabric disposed in overlying relationship to define an exterior surface and an interior surface of said carrier body, said overlying exterior and interior surfaces having contiguously disposed longitudinally and transverse edge portions to define a pocket therebetween, a resilient pad substantially co-extensive in shape with said interior and exterior surfaces disposed within said pocket, a sewn seam for securing together the contiguous edges of said overlying surfaces to confine said resilient pad within said pocket, a first pair of spaced apart straps connected to a transverse edge of said carrier body at one end thereof and extending outwardly therefrom, a second pair of spaced apart complementary straps connected to the exterior surface of said carrier body opposite said first paid of straps, said carrier body adapted to be reversely folded about a pair of skis disposed in back to back relationship at a point intermediate the length of the skis, whereby said carrier body is firmly secured about said skis by wrapping said first pair of straps about said reversely folded carrier body and in overlying relationship with said second pair of complementary straps, said first and second pair of straps having complementary hook and pile surfaces capable of maintaining said straps securely fastened to one another.

2. A padded ski carrier as defined in claim 1 and including a handle strap, said handle strap being connected to said carrier body exteriorly thereof and opposite the fold about which said carrier body is reversely folded about the skis.

3. A combination comprising:

a pair of snow skis arranged in side by side relationship whereby the bottom of said skis are contiguously disposed, and a padded carrier to facilitate the portage of said pair of skis in either of several positions in a comfortable and effortless manner, said padded carrier including:

a resilient rectangular body having a length approximately twice the width of said skis, said body including a soft cushioning material, and said body being adapted to be reversely folded about said pair of skis in said side by side relationship, a first pair of spaced apart straps connected to one end of said body and extending outwardly thereof, and a second pair of complementary straps connected to the opposite outer side of said body whereby said carrier body is firmly secured about said pair of skis by wrapping said first pair of straps about said reversely folded body and in overlying relationship with said second pair of straps, said first and second pair of straps having complementary hook and pile surfaces capable of maintaining said straps securely fastened to one another, when disposed in overlying relationship, and an external handle strap connected to said body at the fold of said body whereby said skis can be readily carried by said handle or on one's shoulder whereby said padded carrier functions as a shoulder pad to cushion the weight of the skis on one's shoulder.

* * * * *